United States Patent [19]

Allen, Jr.

[11] 4,241,797

[45] Dec. 30, 1980

[54] IMPACT TOOL FOR DISLODGING STUCK DRILL BITS

[75] Inventor: John W. Allen, Jr., Lake Charles, La.

[73] Assignee: James P. Creaghan, Lake Charles, La. ; a part interest

[21] Appl. No.: 75,114

[22] Filed: Sep. 13, 1979

[51] Int. Cl.[3] ..... E21B 21/00

[52] U.S. Cl. ..... 175/237; 175/296; 175/317; 299/17

[58] Field of Search ..... 173/78; 175/296, 317, 175/237, 67; 166/166, 264; 239/DIG. 22; 137/538; 299/17

[56] References Cited

U.S. PATENT DOCUMENTS

| | | | |
|---|---|---|---|
| 2,882,020 | 4/1959 | Carr et al. | 175/237 |
| 3,799,278 | 3/1974 | Oliver | 175/237 |

*Primary Examiner*—William F. Pate, III

*Attorney, Agent, or Firm*—George R. Douglas, Jr.

[57] ABSTRACT

An improved impact tool being attached to a drill stem about ten (10) or more feet above the drill bit, and in drilling mud flows through the impact tool to the drill bit when the well is being drilled. When the drill becomes stuck, plunger means is inserted through the drilling mud passage way from the ground level and is forced down to the impact tool by pressure of the drilling mud, and on reaching the impact tool, it engages a lip forming surface at the upper end of the impact tool and seals off the flow of drilling mud. The pressure placed on the drilling mud flowing from ground level forces a set of sleeves to move downward against the force of a helical spring, causing the drilling mud to flow through a jet contoured nozzle for directing the drilling mud toward the stuck drilling bit for thereby dislodging the drilling bit.

6 Claims, 1 Drawing Figure

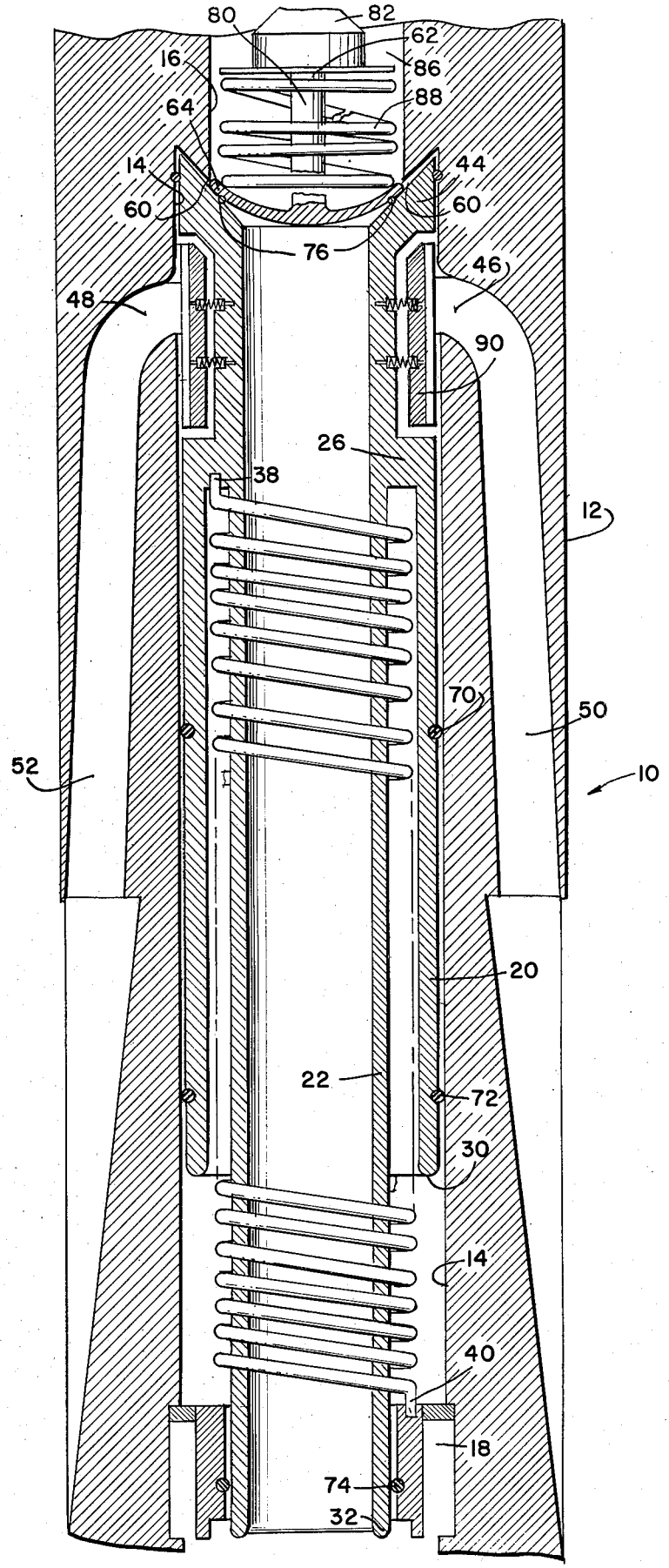
80
82
62
16
86
88
64
14
44
60
60
76
46
48
90
26
38
12
70
50
52
10
20
22
72
30
14
40
18
74
32

IMPACT TOOL FOR DISLODGING STUCK DRILL BITS

CROSS REFERENCE TO RELATED INFORMATION AND PRIOR ART

This application is a substitute for Ser. No. 673,414, now abandoned.

The present invention is an improved impact tool structure over several and various prior art disclosures including:

ZUBLIN U.S. Pat. No. 2,108,955;
JOHNSON U.S. Pat. No. 2,293,259;
HAMMER U.S. Pat. No. 2,885,186;
BROWN U.S. Pat. No. 3,236,319;
MILLER U.S. Pat. No. 3,645,346.

None of the patents show the plunger, the sleeve arrangement, and the jet nozzle configuration for directing drilling mud to a stuck drill bit, and which is normally closed when the drill bit is in use.

BRIEF SUMMARY OF THE INVENTION

The present invention relates to a new and improved impact tool for attachment in line in a drilling stem and in which the improved impact tool is adjacently above a drill bit, the impact tool being used for dislodging a stuck drill bit.

More particularly, the invention related to an arrangement that if a drill becomes stuck the Kelley is broken off above the rotary point on the surface and a plugger means is inserted until a rubber seal thereon comes to rest at or near a lip forming surface. The Kelley is put on the drill pipe and pressure is brought to bear to depress a helical spring in a sleeve arrangement in the impact tool, due to the fact that the plunger means impedes flow of drilling mud through the impact tool, and the pressure is continued until the sleeve arrangement is displaced for allowing drilling mud to pass through a jet and nozzle arrangement so that mud is directed under pressure downwardly from inside of the drill collar to the outside thereof for cutting away and removing sticky and impeding formations preventing the string from turning or from causing the drill bit to be stuck.

FIELD OF THE INVENTION

An object and feature of the present invention is that it provides apparatus to free a stuck drill string by dislodging the stuck drill bit and forcing the drilling mud to flow under pressure from the inside of the drill collar to the outside thereof and directing it through a nozzle downwardly toward the drill bit and thereby cutting away the formation which prevents the drill bit from turning.

A further and additional object and advantage of the present invention is that there is provided compact and simply installed impact tool attachment in a drilling stem for providing ease and great facility in dislodging stuck drill bits. When the drill bit is unstuck, a plunger that is used to set off the dislodging action is easily and readily removed from the hollow central portion of the drill stem and regular course of drilling can be resumed.

A further and additional object of the present invention is to provide means from the surface or ground level for applying force against a helical spring-set of sleeve arrangements for allowing drilling mud to be diverted outwardly from the hollow center of the drill stem and downwardly under force due to the nozzle effect for dislodging material and impediments that have caused the drill bit to become stuck.

The above features of the invention are distinctive over those of any known and found in the prior art disclosures in that some of the prior art show means for alledgedly loosening or dislodging material and impediments from a drill bit at the drill bit internally of the arrangement, or provide means for developing bottom hole pressure release means all in the drill bit, or to prevent clogging of a drill bit by forcing bit cuttings up through outside of the drill stem from the bottom of the hole upwardly through the drill pipe, or by providing a device for freeing a stuck drill bit string from inside the drill bit. While these have been found to be of some advantage, it is found that the apparatus and method of the present invention is unique in that it is completely controlled from the surface and there is directed downwardly from a point near the drill bit a flow of drilling mud directed toward the impediments that the drill bit are in for releasing sticky formations that prevent the string from turning.

BRIEF DESCRIPTION OF THE DRAWINGS

The above and other objects and advantages of the invention will become apparent upon full consideration of the following detailed description and accompanying drawings in which:

The FIGURE is a partially cross sectional view taken along the vertical axis of the improved impact tool used as an attachment in a drilling stem disposed adjacently above a drill bit and to be used for dislodging stuck drill bits, in accordance with a preferred and best mode of the present invention.

DETAILED DESCRIPTION OF THE PREFERRED EMBODIMENT

Referring now to the drawings there is shown an improved impact tool 10 bits (not shown). The impact tool 10 has a casing 12 of generally cylindrical configuration, and there is a hollow cylindrical opening or center 14 extending axially along the length internally of the casing 12. The hollow center 14 provides connections along the drilling stem from the ground level end thereof to a drill bit, so that drilling mud is communicated under pressure from the ground to the drill bits. The hollow center 14 is shown as being of generally a common diameter throughout except at its upper end where it is smaller and in diameter as shown in portion 16 of the follow center. It is the hollow center portion 16 that extend at a generally common diameter upwardly to the earth's surface or ground connection.

There is disposed toward the lower portion of the impact tool a steel ring 18 securely affixed to the inner wall of the hollow center 14 and it extends circularly around the entire wall or hollow center 14. Disposed within the hollow center 14 is a set of concentrically disposed metal sleeves, 20, 22 such that the outer sleeve is 20 and the inner sleeve 22 is concentrically disposed therewith along the common axis of the impact tool 10. The sleeves 20, 22 are made integral or may be connected together in any convenient fashion at the integrally coupled portion 26 which is at an upper portion of the set of sleeves. The outer sleeve 20 is constructing having its lower end or tip 30 foreshortened so that it is substantially shorter in dimension than the inner sleeve 22. The inner sleeve 22 extends further and downwardly so that its lower end or terminus 32 extends beneath the metal ring 18 and is in essentially and general telescopic relation or engagements therewith.

There is shown a helical spring 36 interposed between the sleeves 20, 22 and its upper terminus 38 is engaged in the coupling 26 for the sleeves 20, 22 and the lower terminus 40 of the helical spring rests against or engages with the steel ring 18. The spring 36 is of sufficient strength and resilience that it holds the set of sleeves 20, 22 so that its upper end 44 engages the upper end of hollow center 14, as is shown. The upper section of sleeve 20 extends across and closes off a jet contoured nozzle or series of nozzles 46, 48, and these nozzles extend downwardly for directing mud flow in the direction of the nozzle 50, 52 and peripherally of the impact tool casing 12.

There may be recessed or imbedded in the outer sleeve 20 a cylindrically contoured elastomeric or rubber ring that is disposed circumferentially within the outer sleeve 20 for sealing off the entrance to the nozzle 46, 48 when the nozzle is not in use. The upper section 44 of the outer sleeve terminates in a lip forming arrangement or surface 60 that is of generally conic section and is particularly adapted for receiving plunger means or plug construction 62 having a convex surface for interengaging with the lip surface 60. The plunger or plug 62 is inserted from the ground level when the drill bit has become stuck or is restricted in this operation due to the environment that it is drilling in, and by inserting the plunger 62 within the hollow opening 16 and allowing it to be driven downwardly by the flow of drilling mud introduced at the top of the drill stem, the plunger is caused to engage with the lip forming surface 60 and closing off this passage way through the impact tool, but it displaces the set of sleeves 20, downwardly against the force of the helical spring 36 until the drill mud disposed above the concave plunger 64 is released and driven through the nozzles 46, 48 so that the mud flow is directed downwardly and peripherally of the impact tool casing so that its flow toward the drill bit dislodges the drill bit from its impeded position.

There is seen to be disposed within the drawing a plurality elastomeric sealing means 70, 72, 74 for providing a tightness and sealing effect between the member adjacent to it. By this means there is assured elimination of leakage of drilling mud when drilling mud is driven through the nozzles 46, 48. There is also elastomeric seal members or a composite sealing ring 76 disposed in the convex surface 64 of the plunger 62 as it engages the lip surface 60.

It is seen in the drawing that the plunger may be of any of various constructions and arrangements, but one embodiment is where it is provided with a centrally disposed shaft 80 a head portion 82, and a plurality of spaces 86, 88 so that the plunger 62 is axially disposed within the follow opening 16. Thus the plunger is disposed centrally of the opening 16 throughout the drill stem. It is also shown that the elastomeric ring 90, described above may be secured to the recessed portion of the set of sleeves 20, 22 by means of sets of steel Allen screws and a tension spring so that adjustments may be made in centering this annular, hard rubber ring 90 on the set of sleeves 20, 22. When it is desired to repair or provide positive maintenance to the impact tool, the assembly may be taken apart by removal of the steel ring 18 by appropriate securing means (not shown) but are well known in this and the machine arts.

Additional embodiments of the invention in this specification will occur to others and therefore it is intended that the scope of the invention be limited only by the appended claims and not by the embodiment(s) described hereinabove. Accordingly, reference should be made to the following claims in determining the full scope of the invention.

What is claimed is:

1. An improved impact tool for attachment in line in a drilling stem adjacently above a drill bit and comprising:

an impact tool casing having a cylindrically contoured hollow center for connecting a ground level end of the drill stem with a drill bit, a steel ring means disposed at a lower section within said hollow center of said impact tool casing, a set of concentrically disposed metal sleeves disposed within said hollow center of said impact tool casing being integrally coupled at an upper portion thereof, the outer sleeve having its lower end foreshortened respecting the lower end of the inner sleeve, the inner sleeve having an outer surface of its lower end essentially telescopically engaging with the inner surface of said steel ring means, a helical spring disposed between said sleeves and providing sufficient tension to support said set of sleeves when said spring has its lower terminus engaging said steel ring means and its upper terminus engaging said at means where the sleeves are integrally coupled, and an upper section of said outer sleeve closing off a jet contoured nozzle for directing mud flow downwardly peripherally of said impact tool casing.

2. The invention of claim 1 wherein said upper section of the outer sleeve terminates in a lip forming surface for receiving plunger means thereupon when inserted into said drill stem at the ground level when said drill bit becomes stuck, said plunger means engaging with said lip forming surface for closing and sealing off flow of drilling mud from being further introduced at the top of the impact tool casing thereby causing and resulting said spring to depress and forced downwardly causing flow of said drilling mud to pass to said nozzle for directing thereby said drilling mud to flow toward said drill bit for dislodging said drill bit.

3. The invention of claim 1 wherein a rubber ring is provided circumferentially disposed within the outer sleeve to seal off the entrance to the nozzle when the nozzle is not in use.

4. The invention of claim 1 wherein elastomeric sealing means are disposed between the outer sleeve and the hollow center at a plurality of positions to assure elimination of leakage of drilling mud.

5. The invention of claim 2 wherein said plunger means is constructed to have a convex surface and hard elastomeric seal means is provided on the convex surface to engage the lip forming surface.

6. The invention of claim 1 wherein said plunger means is provided with a shaft and centering means for disposing said shaft centrally with said hollow center of the drill stem.

* * * * *